US006948545B1

(12) United States Patent
Cheng et al.

(10) Patent No.: US 6,948,545 B1
(45) **Date of Patent: *Sep. 27, 2005**

(54) WINDOW COVERING HEIGHT ADJUSTMENT METHOD AND APPARATUS USING TRAVELING ROTOR

(75) Inventors: Li-Ming Cheng, Kaohsiung (TW); Lawrence S. Wu, Rowland Heights, CA (US)

(73) Assignee: Zipshade Industrial (B.V.I.) Corp., Ontario, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/832,877

(22) Filed: Apr. 26, 2004

Related U.S. Application Data

(63) Continuation of application No. 10/162,341, filed on Jun. 5, 2002, now Pat. No. 6,761,202.

(51) Int. Cl.[7] ..... E06B 9/30
(52) U.S. Cl. ..... 160/170; 160/84.04
(58) Field of Search ..... 160/170, 171, 160/172 R, 277, 84.06, 84.04, 178.1 R, 173 R, 160/168.1 R, 167 R

(56) References Cited

U.S. PATENT DOCUMENTS

| | | | | |
|---|---|---|---|---|
| 2,486,492 | A | 11/1949 | Redman | |
| 2,546,534 | A | 3/1951 | Znidarsic | |
| 2,618,329 | A | 11/1952 | Nelson | |
| 2,624,086 | A | 1/1953 | Schaefer | |
| 2,697,487 | A | 12/1954 | Nelson | |
| 2,874,612 | A | 2/1959 | Luboshez | |
| 4,673,018 | A | 6/1987 | Judkins | |
| 5,158,127 | A | 10/1992 | Schumacker | |
| 5,918,656 | A | 7/1999 | Daniels et al. | |
| 5,947,176 | A | 9/1999 | Judkins | |
| 6,059,004 | A | 5/2000 | Oskam | |
| 6,131,640 | A | 10/2000 | Judkins | |
| 6,644,372 | B2 * | 11/2003 | Judkins | 160/84.04 |
| 6,761,202 | B1 * | 7/2004 | Cheng et al. | 160/170 |
| 2002/0088562 | A1 * | 7/2002 | Palmer | 160/170 |

* cited by examiner

*Primary Examiner*—Blair M. Johnson
(74) *Attorney, Agent, or Firm*—William W. Haefliger

(57) ABSTRACT

A method of controlling the vertical height of a window shade having a top and bottom, which includes providing shade upper support structure at or proximate the shade top; providing at least one substantially vertically elongated shade support line extending downwardly from the upper support structure, and providing shade lower support structure at or proximate the shade bottom; elevating or lowering the shade lower support structure relative to one or more support lines; and securing the shade lower support structure to the line or lines at a selected height position relative to the line length above the lower support structure, whereby the height of the shade bottom can be quickly manually adjusted by adjustment of the height of the shade lower support structure effective securement to line or lines.

5 Claims, 5 Drawing Sheets

WINDOW COVERING HEIGHT ADJUSTMENT METHOD AND APPARATUS USING TRAVELING ROTOR

This app. is a CON of Ser. No. 10/162,341 filed Jun. 5, 2002 now U.S. Pat. No. 6,761,202.

BACKGROUND OF THE INVENTION

This invention relates generally to control or adjustment of window coverings, and more particularly to ease and efficiency of window covering height adjustment. Such window coverings are referred to as shades, or blinds, or window coverings generally, and may be formed by pleats of a single piece of material, or by other configuration.

There is need for improvements in adjustability of such coverings or shades, as for example where the effective window covering height of the shade is to be adjusted. In the past, pleated shades were suspended by their own material, i.e. were allowed to hang, causing the weight of the shade to expand the pleats. It was then difficult to accurately adjust shade height, since over time the shade weight could expand the pleats, changing the overall height of the shade. Such pleated shades typically consisted of paper. Also venetian blinds and all window coverings require raising and lowering functions.

SUMMARY OF THE INVENTION

It is a major object of the invention to provide an easily adjustable means allowing shade height adjustment, and where only a minimum number of shade supporting lines are required.

Basically, the improvement comprises a) upper support structure at or proximate the shade top, b) at least one substantially vertically elongated shade support line extending downwardly from said upper support structure, c) shade lower support structure at or proximate the shade bottom, and shade adjustment includes:

d) elevating or lowering the shade lower support structure relative to the one or more support lines, e) and effectively securing the shade lower support structure to the line or lines at a selected height position relative to the line length, f) said securing including effecting adjustable wrapping of the line or lines about a rotary drum or drums provided and positioned at said lower support structure, to travel therewith, g) whereby the height of the shade bottom can be quickly manually adjusted by adjustment of the height of the shade lower support structure.

As will appear, the shade is typically provided in the form of a sequence of pleats, and the line or lines is or are located adjacent such pleats.

Another object includes provision for weight of the lowermost extent of the shade to be carried by the shade lower support structure as that lower support structure is elevated to shorten the height of the shade. As the shade lower support structure is adjusted upwardly, the line below that support structure is typically wound automatically by a traveling drum or drums associated with and below the lowermost support structure.

A further object is to provide for encasing the drum or drums in a housing or housings, and supporting the shade lower support structure on the housing or housings.

The housings are typically located at laterally spaced locations and directly beneath or inside the lower support structure.

Another object includes provision of a spring or springs associated with the drum or drums, and acting to urge the drum or drums in rotary direction to automatically wind the line or lines.

A further object includes provision of a support shoulder on upper extent of, said housing or housings to engage lowermost surfaces of the lower support structure, and acting to orient said housing or housings relative to said shade support structure to enable line winding.

An additional object includes provision of a manipulable line gripping stop, in association with each housing, to grip the line in shade height adjusted position, and to loosen the line for winding or unwinding as the shade height is adjusted.

These and other objects and advantages of the invention, as well as the details of an illustrative embodiment, will be more fully understood from the following specification and drawings, in which:

DRAWING DESCRIPTION

Figure 1:
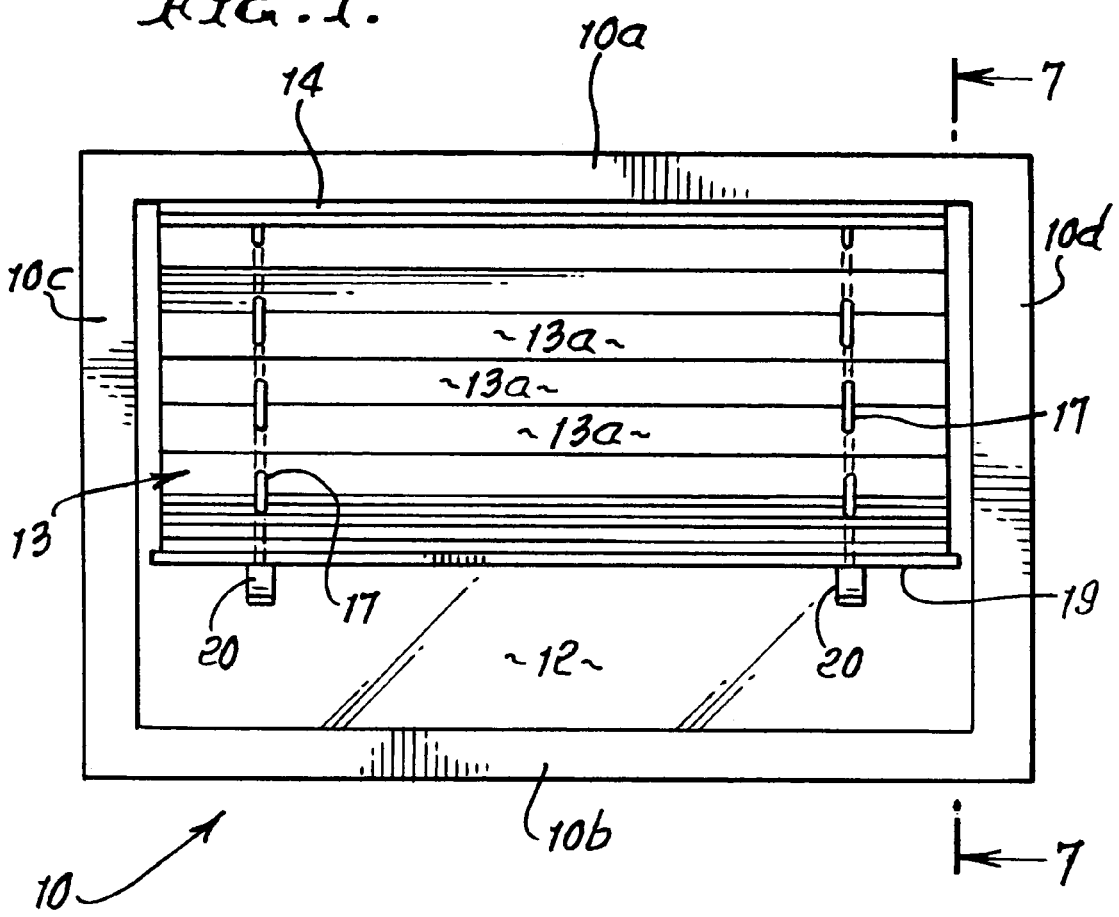
FIG. 1 is an elevation showing an adjustably supported window shade.
Figure 6A:
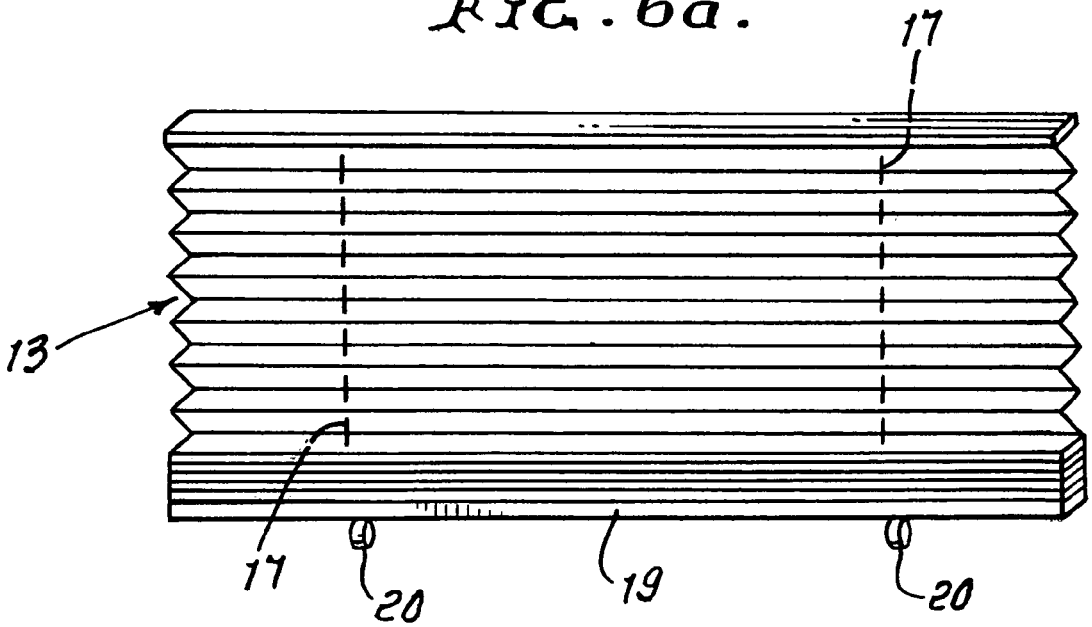
Figure 6:
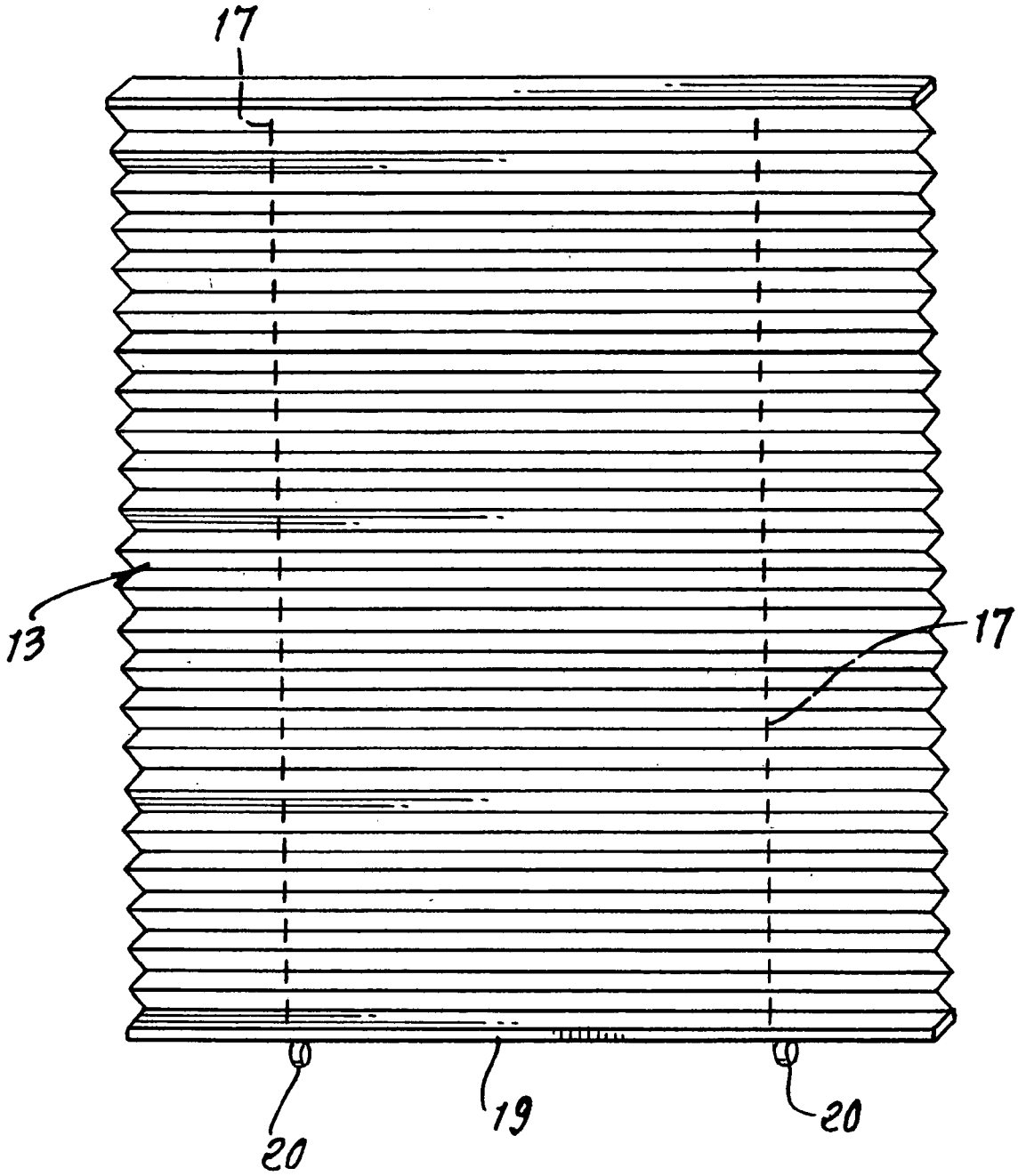
Figure 7:
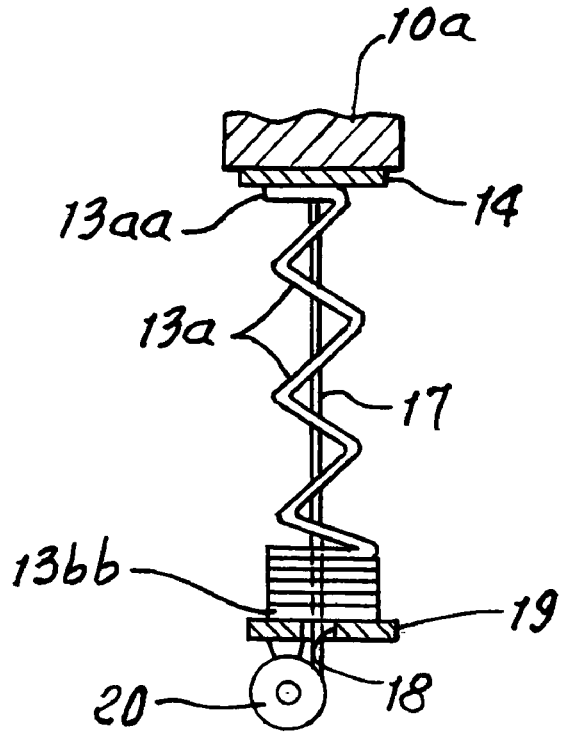

FIGS. 6 and 6*a* are elevational view showing shade full lowering and shade partial raising;

FIG. 7 is an end elevation taken on lines 7—7 of FIG. 1; and

Figure 8:
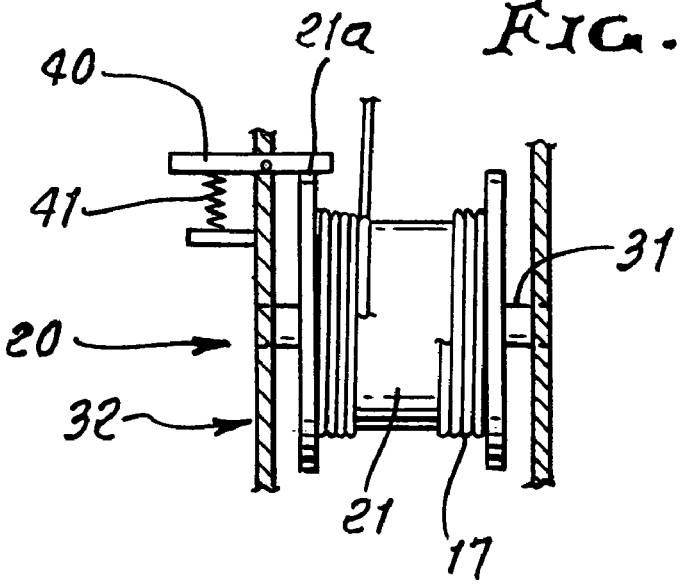

FIG. 8 shows a line providing drum in a case, with a finger control to engage a line.

DETAILED DESCRIPTION

In FIG. 1, shade upper support structure is shown at 10, as in the form of a horizontal upper part 10*a* of a window frame. The frame also includes frame lower part 10*b*, and verticals at 10*c* and 10*d*. The window may for example include a glass pane 12.

A window shade or cover is shown at 13, and may include pleats 13*a*, which expand apart to extend diagonally back and forth, when the shade is hung. An upper shade support structure is located at or proximate the shade top. See for example horizontal slat 14 the upper side of which may be attached to the frame part 10*a*, as for example by tape having adhesive at its opposite sides.

At least one, and preferably two support lines or cords 17 are suspended from slat 14, the two illustrated lines 17 being spaced about horizontally. Those lines pass downwardly through holes in the pleats, as seen in FIG. 7, and they also pass downwardly loosely through holes or openings 18 in a shade lower support structure located at or proximate the shade bottom. As shown, the lower support structure comprises a horizontally elongated lower slat 19. The uppermost pleat 13*aa* may be attached to the underside of the upper slat 14; and the lowermost pleat 13*bb* may be attached to the upper side of the lower slat 19. The attachments may be made by use of dual adhesive sided tape.

The shade height may therefore be adjusted by manually elevating or lowering the lower slat 19, relative to the line or lines 17, and securing it in adjusted position.

Figure 2:
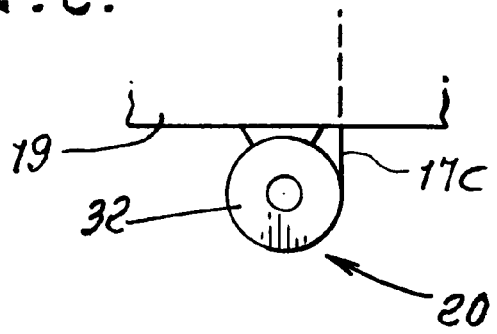
FIG. 2 is an enlarged elevational view, showing use of a line wrapping device below the shade lowermost support portion.

Such securing is preferably made by traveling line wrapping adjusting device or devices 20, whereby the lower slat 19 is held in selected elevated position by those devices 20. As shown in FIG. 2, the slat 19 seats on device 20, and the cord lower extent 17*c* is automatically wrapped on a drum 21 in a case 32, of device 20. See FIG. 3. The preferred method of use includes:

d) elevating or lowering the shade lower support structure relative to one or more support lines, e) and effectively securing the shade lower support structure to the line or lines at a selected height position relative to the line length above that lower support structure, f) such securing including effecting adjustable wrapping of the line or lines about a rotary drum or drums provided and positioned at that lower support structure to travel therewith, g) whereby the height of the shade bottom can be quickly manually adjusted by adjustment of the height of the shade lower support structure.

Figure 3:
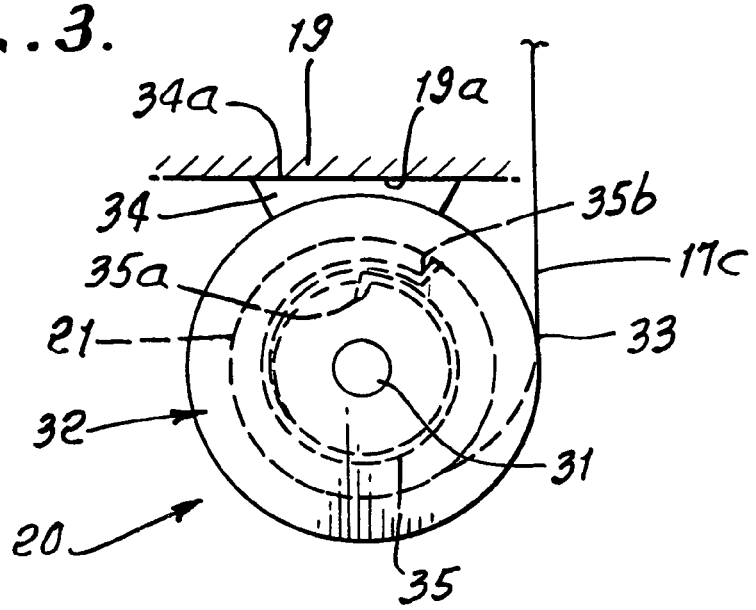
FIG. 3 is a view showing line wrapping drum and spring structure.

FIGS. 2 and 3 show a rotary drum 21 on a shaft 31 carried inside a case or housing 32. The latter is located adjacent the slat 19, so that line 17 enters the housing at 33, and winds on the drum. The case is typically located just below slat 19, and is carried by the slat. An abutment 34 may be carried by the case, to have its upper flat side 34*a* in engagement with the lower side 19*a* of the slat 19.

A spring 35 in the case urges drum in a rotary direction tending to wind up the line 17 on the drum. Accordingly, as the slat 19 is raised, as by hand, the case 32 moves up, and the drum winds up the line that would otherwise dangle. Note coil spring turned ends 35*a* and 35*b* connected to the case and to the drum. Likewise, as slot 19 is pulled down, or lowered, the drum 21 rotates to spool off the amount of line 17, to accommodate such lowering.

If need be, a line gripping stop or control 40 may be provided, as shown in FIG. 8, to grip the drum, in adjusted position of the slat 19. See for example lever 40 urged by a spring 41 to grip the drum flange 21*a*, and released by finger pressure to allow drum rotation.

Figure 4:
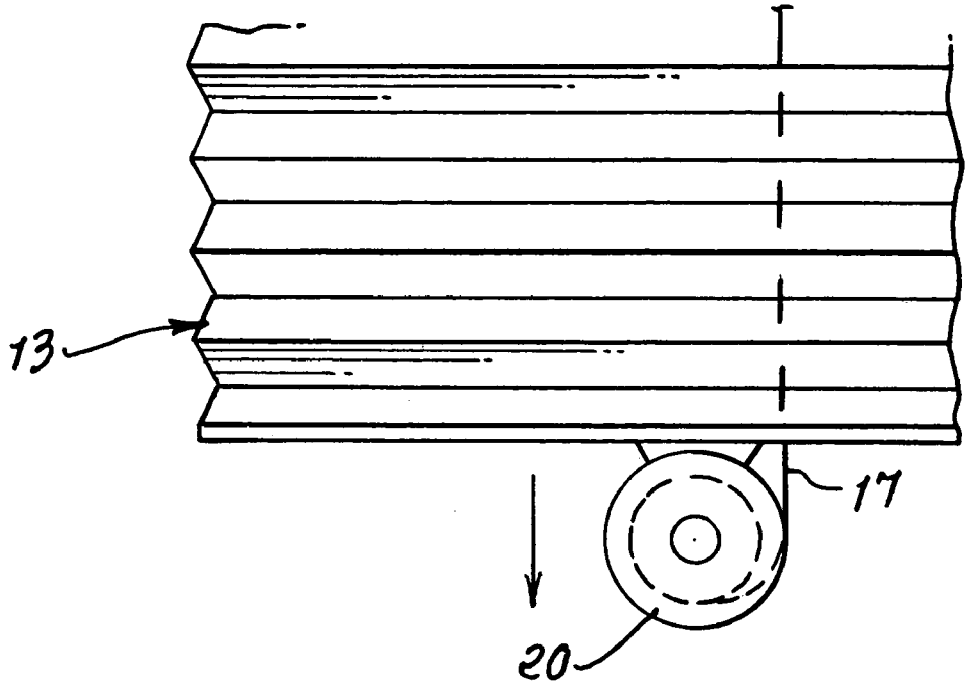
FIG. 4 is an enlarged diagrammatic view showing shade lowering.
Figure 5:
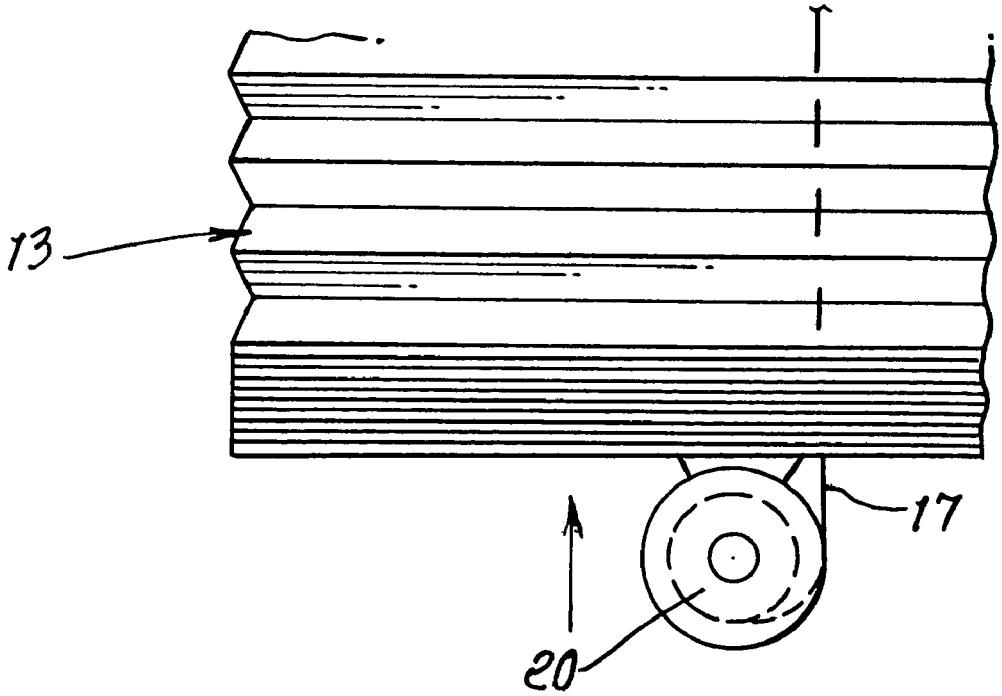
FIG. 5 is a view like FIG. 4 showing shade raising.

FIG. 4 schematically shows the operation of shade lowering; and FIG. 5 schematically shows the operation of shade raising to gather pleats. FIG. 6 shows two casings 20 spaced apart laterally below such lower slot 19, to support the shade in lowered position. Lines 17 extending above the drums wind up on drums within the casings as the shade lower slat 19 is raised. FIG. 6*a* shows the two casings, during raising of the shade.

We claim:

1. The method of controlling the vertical height of a window shade having a top and bottom, and pleats therebetween which includes the steps a) providing shade upper support structure at or proximate the shade top, b) providing at least one substantially vertically elongated shade support line extending downwardly from said upper support structure, c) and providing shade lower support structure in the form of a substantially horizontally extending slat for supporting pleats gathered or gathering at or proximate the shade bottom, d) elevating or lowering said shade lower support structure relative to said one or more support lines, e) and effectively securing said shade lower support structure to the line or lines at a selected height position relative to the line length above said lower support structure, by providing a holder or holders by which said line or lines are each adjustably held, and openly exposed entirely below said slat, and said holder or holders each including a spring or springs transmitting force acting to engage a drum or drums that control winding of said line or lines, f) whereby the height of the shade bottom can be quickly manually adjusted by adjustment of the height of the shade lower support structure, and said spring or springs.

2. The method of claim 1 wherein said shade is provided in the form of a sequence of pleats, and said line or lines is or are located adjacent said pleats and passing through said pleats at locations in vertical-alignment with said holder or holders.

3. The method of claim 1 wherein weight imposed by the lowermost pleats of the shade is carried by said shade lower support structure as said lower support structure is elevated to shorten the height of the shade.

4. The method of claim 1 wherein lowermost extent of the line or lines is or are extended below said lower support structure, and including supporting said lowermost extent of the line or lines at a location or locations characterized in that said lowermost extent of the line or lines remains extended below said slat.

5. The method of claim 1 wherein said holder or holders have slidable engagement with and is or are adjustable along the line length in response to manual manipulation of said holder or holders.

* * * * *